US007849645B2

(12) United States Patent
Pamboris

(10) Patent No.: US 7,849,645 B2
(45) Date of Patent: Dec. 14, 2010

(54) FLOOD PROTECTION

(75) Inventor: Nicholas Pamboris, Wallington (GB)

(73) Assignee: Aquaflood Protection Systems Ltd, London (GB)

( * ) Notice: Subject to any disclaimer, the term of this patent is extended or adjusted under 35 U.S.C. 154(b) by 840 days.

(21) Appl. No.: 10/514,434

(22) PCT Filed: May 14, 2003

(86) PCT No.: PCT/GB03/02043

§ 371 (c)(1),
(2), (4) Date: May 9, 2005

(87) PCT Pub. No.: WO03/097984

PCT Pub. Date: Nov. 27, 2003

(65) Prior Publication Data

US 2005/0210763 A1 Sep. 29, 2005

(30) Foreign Application Priority Data

May 16, 2002 (GB) ..... 0211162.3
Feb. 7, 2003 (GB) ..... 0302811.5

(51) Int. Cl.

| | |
|---|---|
| ***E04B 7/00*** | (2006.01) |
| ***E04B 1/346*** | (2006.01) |
| ***E04B 1/34*** | (2006.01) |
| ***E04B 2/00*** | (2006.01) |
| ***E06B 3/26*** | (2006.01) |
| ***E04B 1/00*** | (2006.01) |
| ***E04B 1/12*** | (2006.01) |
| ***E04C 2/38*** | (2006.01) |

(52) U.S. Cl. ..... 52/273; 52/202; 52/222

(58) Field of Classification Search ..... 52/169.4, 52/64, 79.1, 3, 408, 169.14, 4, 243, 741.4, 52/23, 1, 746, 2.24, 2.23, 2.25, 506.1, 506.5, 52/169.1, 302.1, 169.5, 222, 208, 273, 63, 52/202, 656.7, 745.15, 741.3; 49/466, 61, 49/70, 477; 135/88.13; 405/114, 25, 111, 405/107, 115, 15, 116, 91, 110, 52, 87, 97, 405/92, 104; 256/12.5; 160/23.1; 137/57; 156/71

See application file for complete search history.

(56) References Cited

U.S. PATENT DOCUMENTS

| | | | | | |
|---|---|---|---|---|---|
| 2,485,280 | A | * | 10/1949 | Grace | 254/98 |
| 3,367,620 | A | * | 2/1968 | Holt | 249/213 |
| 3,895,468 | A | * | 7/1975 | Bernstein | 52/222 |
| 4,425,744 | A | * | 1/1984 | Villareal | 52/169.14 |
| 4,443,018 | A | * | 4/1984 | Samol et al. | 277/632 |
| 4,473,982 | A | * | 10/1984 | Monari | 52/222 |
| 4,817,655 | A | * | 4/1989 | Brooks | 135/121 |
| 5,022,688 | A | * | 6/1991 | Arnoldt | 285/363 |
| 5,173,344 | A | * | 12/1992 | Hughes | 428/36.1 |
| 5,290,045 | A | * | 3/1994 | Terauchi et al. | 277/312 |
| 5,373,792 | A | * | 12/1994 | Pileggi et al. | 105/406.1 |
| 6,179,398 | B1 | * | 1/2001 | Martin | 312/265.4 |
| 6,273,433 | B1 | * | 8/2001 | Yu | 277/629 |
| 6,460,299 | B1 | * | 10/2002 | Burrow | 52/169.14 |
| 2003/0188498 | A1 | * | 10/2003 | Lewkowitz | 52/208 |

FOREIGN PATENT DOCUMENTS

| | | | | |
|---|---|---|---|---|
| DE | 9213822.5 | U1 | | 12/1992 |
| DE | 195 03 292 | A1 | | 8/1996 |
| DE | 199 51 487 | A1 | | 5/2001 |
| EP | 1138866 | A2 | | 10/2001 |
| GB | 2 346 405 | A | | 8/2000 |
| GB | 2346644 | A | * | 8/2000 |
| WO | WO 97/13052 | A1 | | 4/1997 |

OTHER PUBLICATIONS

International Search Report, Patent Cooperation Treaty; Sep. 1, 2003.

"European Examination Report and Communication Pursuant to Article 94(3) EPC" dated Mar. 31, 2008 cited in corresponding European application to the instant application.

* cited by examiner

*Primary Examiner*—Brian E Glessner
*Assistant Examiner*—Omar Hijaz
(74) *Attorney, Agent, or Firm*—Fredrikson & Byron, P.A.

(57) ABSTRACT

A flood protection system for a building employs waterproof flexible sheeting (26) of a size at least sufficient to cover a region to be protected on one or more faces of a building. The sheeting is capable of withstanding water pressure at least with a head as great as the difference in height from the lowest to the highest point of the region. The sheeting has a first side and an opposite side on the side of the sheeting opposite the first side. The first side is arranged to bear against the surface of the building at least around the periphery of the region and an opposite side. A frame of similar dimension to the sheeting is used to mount the sheeting with its first side against the face of the building. The frame co-operates with compressible sealing means (23, 24) which bear against the opposite side of the sheeting to thereby press the first side against the face of the building. Fixing means mount the frame to the surface of the building without the fixing means piercing the sealing means.

27 Claims, 5 Drawing Sheets

FLOOD PROTECTION

This invention relates to flood protection.

Many areas of the world are subject to periodic flooding either in flash floods or by the slower, but equally insidious general raising of ground water levels in wet weather. Indeed, wherever rivers form flood plains, some flooding, at least in winter in temperate regions of the world is a natural phenomenon to be expected.

In Northwest Europe, in particular, pressure on development land in recent years has resulted in much development of housing and industrial sites on former flood plains. The land is easy to build on being generally flat and therefore attractive to developers of low cost housing.

The summer, autumn and winter of the year 2000 proved unusually wet in Northwest Europe; and the occupiers of housing and industrial sites built in recent years on former flood plains found to their dismay that existing river management schemes and flood barriers were inadequate. Considerable damage was done both to domestic and industrial property.

Improved river management schemes and associated flood protection works may help to alleviate the problem to some extent but these schemes are major works requiring planning approval and, often, Government finance, and therefore taking time to come to fruition.

The general belief is that the flood problem will worsen over time as a result of the climatic changes arising in the early stages of global warming.

This leaves householders and the occupiers of industrial sites with a present and pressing problem, namely how to protect their existing buildings from anticipated further bouts of flooding, whether or not ambitious future flood protection works are put in hand.

The most common means to resist flooding is the ubiquitous sand bag. To be effective sand bags must be placed in position as soon as there is a flood warning. Since they have to be filled and distributed from central depots (it is usually not practicable for individual householders to keep their own supply of sand bags at the ready) this poses a major logistic problem. Inevitably some properties are left exposed.

It has also been proposed to mount boards across openings to form a flood barrier, possibly together with auxiliary sand bags. Such boards need a frame in which to be fitted and this must be permanently fixed in position. The result is often unsightly in appearance and less than satisfactory in operation.

A number of proposals for flood prevention systems for householders appear in the Patent literature.

For example, Burel in FR 2730001 discloses the use of rigid sheet metal panels to provide temporary flood protection employing seals between the panel and the wall of the building. Buck in GB2360813A proposes a domestic flood barrier in which a barrier panel is designed to be fixed across a window or the like temporarily in a watertight manner when a flood is expected. Buck employs fixing means in the form of a nut mounted in a hole in the building wall and surrounded by a watertight bushing which co-operates with a bolt which passes through his barrier panel and an intervening sealing member. In an effort to prevent ingress of flood water through the opening through the barrier, sealing washers are provided around the bolt Farrell in GB2346405A proposes a flood protection panel having a number of openings therethrough for co-operating fixing means adjacent a door frame and intervening sealing means. Farrow in GB2245297A also proposes a barrier panel to fit across the lower half of a door frame of a building, the top of the barrier apparently being open. Again fixings pass through openings in the barrier and, on some embodiments, seals may be provided along the lower edge. GfB Gesellschaft für Bauwerksabdichtungen mbH in EP0735216A propose flexible foil panels to be hung in front of the brickwork when a flood is expected, the side edges and the lower edge of the foil panels having a circumferential bead-like thickening which is clamped in a frame. Scherrer in FR2763094A proposes an arrangement employing a flexible sheet across a window opening with additional support elements and/or cabling attached to a remote anchorage to hold the sheet in position. Threaded fastenings are used at space positions around the periphery of the sheet and pass through openings in the sheet and in a profiled member mounted against the sheet and are received in openings in the wall. Red Dragon Investments in WO 02/44501 disclose a vertical roll-out arrangement Vredestein Icopro in WO 98/37278 disclose the use of a rubber or plastics seal element with two legs defining a constriction between them. Sheeting passes around a cable snapped into the constriction to hold it in place. von Czarnowski in DE 29919976 U discloses a solid snap-fit cover co-operating with a seal stuck around door and window openings.

Of the arrangements referred to above which appear in the Patent literature, some are clearly so over-engineered as to be incapable of production on an economic industrial scale for use by ordinary householders and others are inadequate in their ability to withstand an anticipated flood.

A more practical flood barrier system that has been built and proven to work, at least to an extent, is proposed in Master Builder, March 2002, pp24-25. A flexible skirt mounted in a subsurface trough is pulled vertically up to surround the entire outer wall of a building. The system relies upon a complete circum-extending skirt. Individual sections of skirt are joined by vertical zips, said to be 'water-tight', but evidently not that reliable since auxiliary pumps are proposed to remove leakage behind the skirt. The skirt is hung by a pole along its upper edge co-operating with a cord system mounted on a permanently fixed horizontal bracket on the outer surface of the building.

For a flood protection system to have universal applicability, it must be capable of being readily manufactured in bulk; it must be capable of being readily mounted and de-mounted by an ordinary householder without requiring special tools; when de-mounted, there should preferably be no unsightly elements protruding from the wall; and finally, the seal between the flood protection system and the wall must be reliable. Wall surfaces surrounding a window opening, for example, are rarely flat. Where brickwork is present there will be pointing between the bricks. Often this means that between each pair of bricks there is a depression provided by the pointing. In other arrangements, the wall surface may be rendered or covered by pebbledash.

The embodiments of my system described in more detail hereinbelow can be readily adapted for a wide range of different circumstances likely to be met in practice by average householders.

In accordance with a first aspect of my invention, there is provided a flood protection system for a building, comprising: waterproof flexible sheeting of a size at least sufficient to cover a region to be protected on one or more faces of a building, the sheeting being adapted to withstand water pressure at least with a head as great as the difference in height from the lowest to the highest point of the said region, the sheeting having a first side and an opposite side on the side of the sheeting opposite the first side, the first side being arranged to bear against the surface of said face(s) of the building at least around the periphery of said region; a frame of similar dimension to said sheeting and adapted to mount said sheeting with said first side against the face of the building, the frame co-operating with compressible sealing means adapted to bear against the opposite side of the sheeting to thereby press said first side against the face of the building; and fixing means for mounting the frame to the surface of the face(s) of the building without the fixing means piercing the sealing means.

Preferably, a second compressible sealing means is positioned alongside the first and is adapted to bear against the face of the building either directly or via the sheeting to thereby provide an auxiliary seal between the frame and the building at a position outwardly, relative to the centre of the said region, of the seal provided by said first sealing means.

The respective sealing means are selected to protrude from the frame and be sufficiently compressible so that they accommodate the surface irregularities commonly found in external walls, such as pebbledash, pointing etc. Preferably the sealing means are formed with slits running therealong, thereby effectively providing a plurality of separately sealing strips. Special hemispherical cavities formed in the sealing surface may also be provided. In use these close as the sealing means is compressed and aid in the accommodation of surface irregularities to provide a fully effective seal.

Because the fixing means do not pierce the seals, the flexible waterproof sheeting can be formed without any through apertures therein. Such apertures may form points of physical weakness in the sheeting and may also serve as points of weakness so far as ingress of water is concerned unless steps are taken to seal the apertures. In other arrangements, there may be apertures, preferably with strengthened edges, for the fixings to pass through, but these will be positioned outwardly of the seal, with regard to the centre of region to be protected. Any leakage through the apertures thus does not destroy the sealing effect.

In one arrangement described in detail below, the sheeting is shaped and dimensioned so as to allow for edge regions which may be wound at least partly about the first compressible sealing means with said first compressible sealing means bearing against the said opposite side of the sheeting.

The frame is suitably formed with a first or outer surface and a second or inner surface provided with respective seats for the first and second sealing means. The surface of the seat for the first sealing means or the first sealing means itself may be provided with a light tack adhesive, preferably of the temporary hold type, facilitating the mounting of the first compressible sealing means with the edge region of the sheeting at least partially wound thereabout in the corresponding seat of the frame. The second sealing means may be permanently adhered to its seat.

In an alternative arrangement, the first compressible sealing means may be provided with location openings therein and the frame provided with location means in said seat adapted for cooperative location with the location openings to assist in mounting of the first compressible sealing means, preferably with the edge region of the seating at least partially would thereabout in the said seat.

In the currently most preferred arrangement, the frame and sealing means simply bear against the opposite side of the sheeting and thereby press the first side thereof against the building surface. There may be inner and outer seals, as described above, both of which bear against the said opposite side. Fixing of the frame to the building is preferably by fixing means passing through apertures in the frame and in the sheeting. The positions of such sheeting apertures, which preferably have strengthened edges, generally lie between the inner and outer seals.

In preferred arrangements the frame is generally rectangular in form, corner regions thereof being provided with a corner sealing gasket adapted for sealing between respective regions of the frame and between the frame and the respective compressible sealing means.

Preferably embodiments of flood protection system in accordance with the present invention are adapted to be mounted to the building surface with the use of a fixing system which, when the flood protection system is not in use, will be either removed and/or hidden from view.

In accordance with a second and alternative aspect of this invention, there is provided a flood protection system for a building, comprising: a plurality of fixings adapted for permanent mounting in the wall of the building at spaced positions which together define a region on one or more faces of the building to be protected, each said fixing providing a socket adapted to receive a plug or cap masking the fixing from view when no flood is expected; a plurality of male fixing members adapted to be received in respective said sockets when a flood is expected; waterproof flexible sheeting of a size at least sufficient to cover the said region and adapted to withstand water pressure at least with a head as great as the difference in height from the lowest to the highest point of the said region; a frame for sealingly mounting the said sheeting across the said region, the frame having an underside adapted to clamp the sheeting against the surface(s) of said face(s) by said male fixing members or means associated therewith with the male fixing members passing through apertures in the frame and being received in the sockets, the frame being dimensioned to extend generally about the entire periphery of the said region, and the said underside defining a channel running therealong; and one or more elongate compressible members adapted to fill said channel and to extend from the said underside in its uncompressed state, whereby the said compressible member(s) is(are) adapted to provide a seal around the periphery of said region, the apertures being located at spaced positions alongside said channel so that said fixings do not pierce the compressible member(s).

The sheeting may have an edge region adapted to be wound at least partly about the member(s) providing said seal in a direction such that the said member(s) bear(s) against the outer surface of said sheeting when the frame is clamped against the surface(s) of said face(s).

Preferably, said underside defines two generally parallel channels running therealong, with said apertures located between said channels at spaced positions; and respective elongate compressible members are adapted to fill the two said channels and to extend from the said underside in their uncompressed state, whereby the said compressible members are adapted to provide respective inner and outer seals for the said region. In arrangements in which the edge region of the sheeting is wound as described above, it will be wound at least partly about the member(s) providing said inner seal.

I have designed a particular fixing and fixing member combination for this purpose and believed novel in its own right.

As described in more detail below, a fixing for permanent mounting in a support such as the face of a building comprises a threaded member provided with a head including an internally threaded socket, the fixing being adapted to be threadedly inserted until the socket head is substantially flush with the face of the support into which the fixing is inserted so that no part of the fixing protrudes from the said surface, the threaded socket being adapted to receive either a cooperating threaded member or a masking plug or cap, selected from threaded plugs and caps and push-fix plugs and caps, to mask the fixing from view.

The aforesaid fixing is suitably arranged to receive a double-ended male fixing member, the said member having a first end which is threaded and a second end opposite to the first, which is also threaded, the first end and the second end being separated by a collar. For use with the aforementioned fixing, the length of the first threaded end is the same as or less than the length of the internally threaded socket of the fixing, both the internal socket and the first end being formed with co-operating screw threads. This enables the fixing member to be used to screw the fixing into the support and then to be removed so that the socket may be plugged by the aforementioned masking plug or cap, in one situation, or for the fixing member to be mounted in the said socket with the said socket mounted in the supporting surface, in an alternative situation, to enable other means, such as the frame of an embodiment of flood protection system in accordance with the present invention, to be mounted on the other end of the male fixing member.

The first and second compressible sealing means are suitably formed of elongate lengths of foam plastics material. The foam may itself possess low tack, enabling it to be stuck in position but also be de-mountable to enable it to be stored for re-use. In alternative arrangements the foam may be provided with a magnetic surface or may incorporate a magnetic material in the foam, so as to aid location of the foam in seats defined in the frame if the frame is also magnetic. As noted above, the second compressible sealing means may be permanently adhered in position in its seat. This may be achieved by supplying this sealing means in a roll with adhesive applied but covered by a removable backing strip, which is simply removed to fit the sealing means into the frame.

Water will always find its own level. Accordingly, if any passage, however small, is left on the exterior of the building, and water can reach it, then the water will eventually reach the interior of the building. Preferably, therefore, separate embodiments of flood protection system should be provided for every aperture on the exterior of the building that may be exposed to water. This will include not only the obvious apertures such as doors and windows, but also ventilation bricks and the like. Alternatively, a single embodiment of flood protection system can cover more than one opening.

The invention is hereinafter more particularly described by way of example only with reference to the accompanying drawings, in which:—

Figure 1:
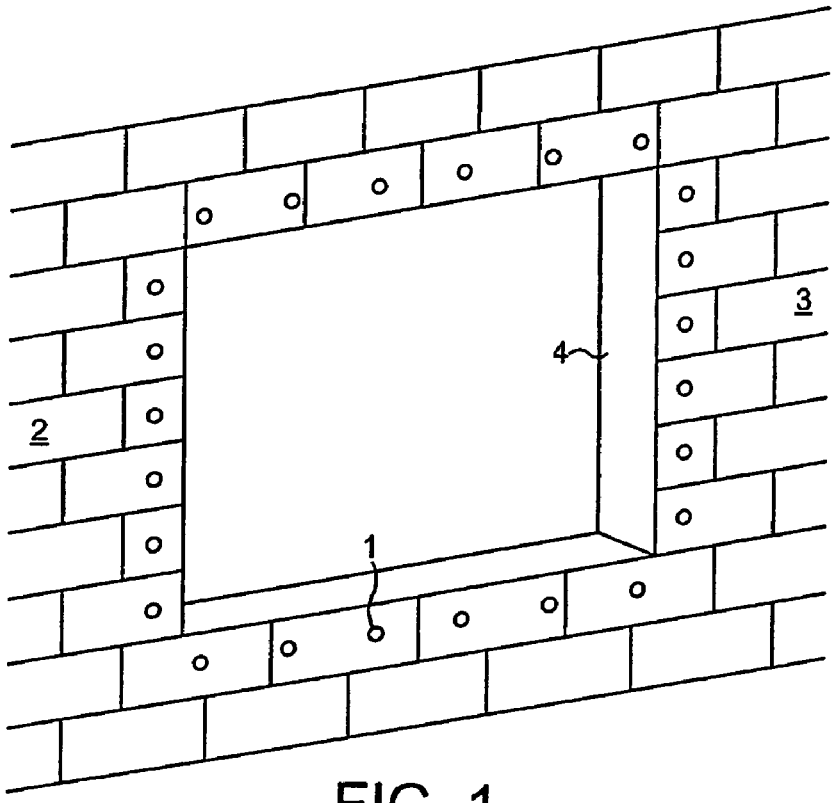
FIG. 1 is a generally schematic view illustrating a region of a building to be protected from flood.

Referring first to the generally schematic view of FIG. 1, a plurality of fixings 1 are provided at spaced positions in the face 2 of a building 3 for mounting a flood protection system designed to protect an opening 4 in the face of the building, typically a door or a window. The fixings are suitably equally spaced along each side of the opening. Other openings such as ventilation bricks should receive similar treatment.

Figure 2:
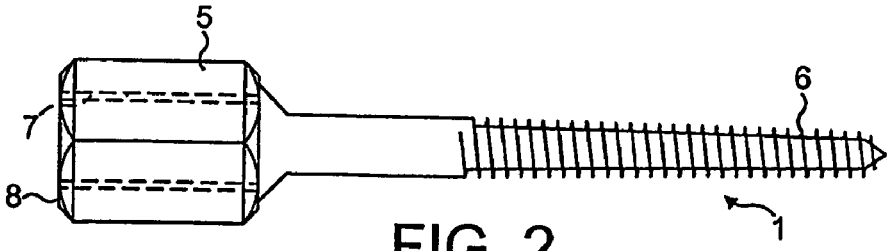
FIG. 2 is an enlarged side elevational view of a fixing for insertion in the face of a building.
Figure 3:
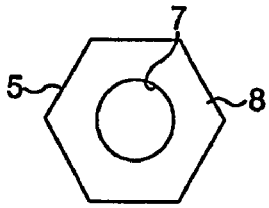
FIG. 3 is an end elevation of the fixing of FIG. 2 taken from the left in FIG. 2.

My preferred embodiment of fixing is illustrated on an enlarged scale in FIGS. 2 and 3. Fixing 1 is provided with a head 5 and a threaded shank 6. Head 5 has an internally threaded socket 7. Fixing 1 is designed for permanent fixture in the face of the building, for example by drilling a hole with a diameter of the order of the cross section of head 5, filling it with filler or other fixing arrangements for screws such as those sold under the Registered Trademark Rawlplug®. Fixing 1 may conveniently be manufactured simply by soldering an hexagonal nut (to form the head 5) to the head of a conventional wood screw (forming the shank 6) by the use of silver solder. Alternatively, it could be formed in one piece or alternatively of two pieces brazed together. Because the fixing is permanently mounted into the wall so that its end face 8 is essentially flush with the wall surface, its socket opening 7 is adapted to receive a plug or cap which, if given the same colouration as the wall surface, will render the fixings essentially hidden until required to mount the flood protection system, as explained in detail below. The plug or cap should have a diameter at least as great as that of head 5 and may be formed with a thread receivable in threaded socket 7 or may simply form a press-fit therein.

Figure 4:
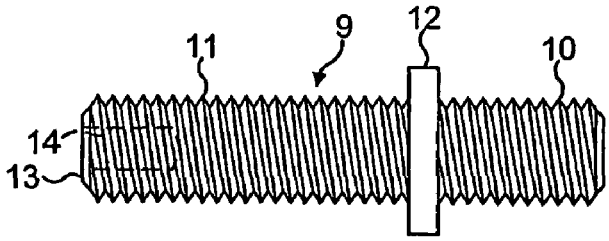
FIG. 4 is a side elevational view of a male fixing member adapted to co-operate with the fixing of FIGS. 2 and 3.
Figure 5:
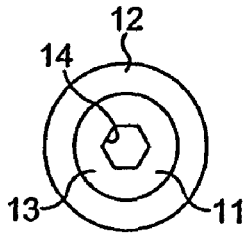
FIG. 5 is an end elevation of the male fixing member of FIG. 4 taken from the left in FIG. 4.

FIGS. 4 and 5 show a double-ended male fixing member 9 adapted for co-operation with fixing 1. Fixing member 9 has a first threaded end 10 adapted to be threadedly received in socket 7. Length L1 of end 10 is accordingly the same as or slightly less than the length of socket 7. The other end 11 of fixing member 9 has a greater length L2 and is separated from first end 10 by a collar 12. Fixing 1 may be screwed into the wall 2 initially by the use of a spanner or the like co-operating with its hexagonal head 5 and finally positioned by inserting threaded end 10 and then using the fixing member 9 to finally screw fixing 1 into position. To aid in this, distal end 13 of the longer end 11 is formed with an hexagonal socket 14 adapted to receive an appropriate tool such as an Allen tool to aid in turning it and the fixing 1. Fixing 1 is suitably made of mild steel, for example EN1A mild steel. Because fixing member 9 is likely to be exposed to water in a flood, it is more suitably made of stainless steel, for example 303 stainless steel.

With male fixing members 9 screwed into position on the permanently mounted fixings 1 about opening 4, preferably with an intervening washer between collar 12 and head 5, the longer ends 11 of male fixing member 9 protrude outwardly from the wall and are used to locate a frame dimensioned to extend around the opening 4 and to clamp waterproof flexible sheeting across the opening and against the surface of the wall.

Figure 6:
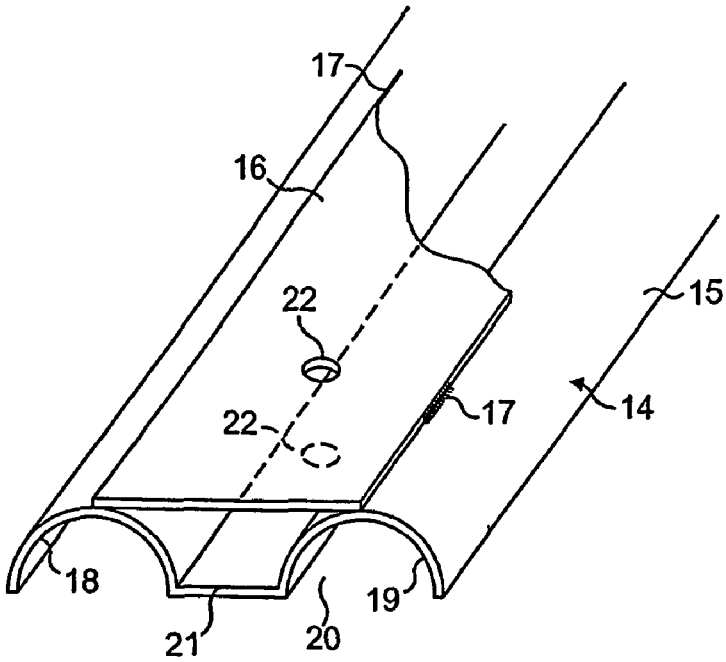
FIG. 6 is a perspective view of a section of frame.

A section of a suitable frame is illustrated in FIG. 6. Frame 14 may be formed from a pressed metal section 15 to which a top bracing plate 16 is spot welded at staggered locations 17 along the length of the bracing plate. As will be seen from FIG. 5, pressed metal section 15 effectively defines two parallel seats 18 and 19 extending therealong on its underside 20.

Both seats 18 and 19 are here shown with a semi-circular cross-section but other configurations are feasible including a trapezoidal or frusto-conical section. For location on threaded ends 11 of the fixing members 9, both the metal section in its central flat portion 21, and the bracing plate 16 are formed with aligned holes 22.

Figure 7:
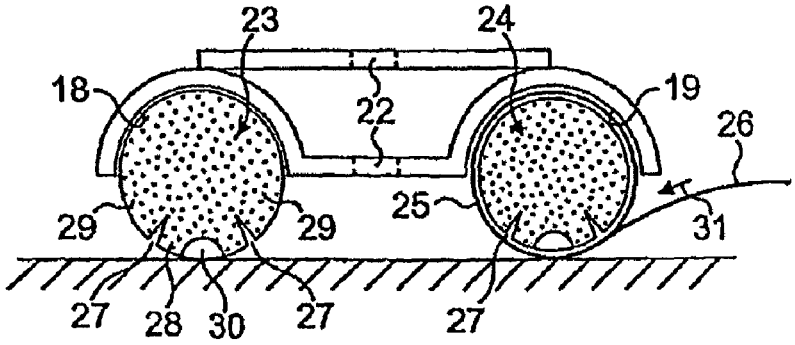
FIG. 7 is a sectional view through an embodiment of flood protection system according to the present invention using the frame of FIG. 6.

Seats 18 and 19 are adapted to receive elongate compressible sealing means adapted to seal the plate against the waterproof flexible sheeting or the wall surface, respectively, as best shown in FIG. 7.

FIG. 7 shows a first elongate compressible member 23 seated in outer seat 18 of the frame 14 and a second elongate compressible sealing member 24 seated in the inner seat 19. In the arrangement illustrated, an edge region 25 of a waterproof flexible sheet 26 is wound at least in part around compressible sealing member 24, as shown in FIG. 7 before this sealing member is pushed into its seat. To allow for this, either the inner seat 19 must be slightly larger than the outer seat 18 or the inner sealing member 24 must be slightly smaller than the outer sealing member 23, but in either case, it is important that edge region 25 of waterproof flexible sheet 26 is wound about sealing member 24 in the direction shown, so that the sealing member sealingly presses against the outer surface of the waterproof sheet to clamp the sheet against the confronting surface of the wall. FIG. 7 shows a typical section for the preferred sealing members. It will be seen that there are two slits 27 in each sealing member. When the sealing member is clamped against the confronting brickwork or the like, for example by a wing nut (not shown) screwed on to the end of the protruding outer end 11 of fixing member 9 which extends through the aligned holes 22, the confronting surface of each sealing member against the wall or against the waterproof sheeting is deformed so that both the surface of its central section 28 and sections 29 outwardly of the slits 27 are pressed against the confronting surface, thereby providing three separate sealing sections against ingress of water. Accordingly, even if one should fail or leak slightly, the others may hold back the water. In the preferred profile, as shown in FIG. 7, the surface of the sealing members confronting the wall or the waterproof flexible sheet have spaced small hemispherical cavities 30 at spaced intervals along the sealing member. These provide additional grip and suction on the confronting surface and help to make up for irregularities in the confronting surface, all of which aids in reliable sealing against ingress of flood.

In an alternative arrangement, the first or inner seal may be formed with a series of such elongate slits 27 at positions about its entire circumference.

As will be appreciated from a consideration of the geometry of FIG. 7, waterproof flexible sheeting 26 is wound about sealing member 24 in a way which would be self-tightening in operation. When exposed to flood water, the water will try to enter into the space between the seal and the sheet in the direction of the arrow 31 in FIG. 7, and the net effect of this will be to further press the waterproof flexible sheeting against the confronting surface of the wall.

Figure 8:
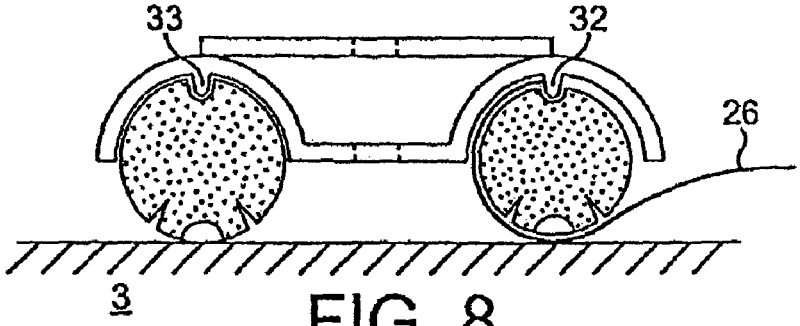
FIGS. 8 and 9 are views similar to FIG. 7 for two alternative embodiments.
Figure 9:
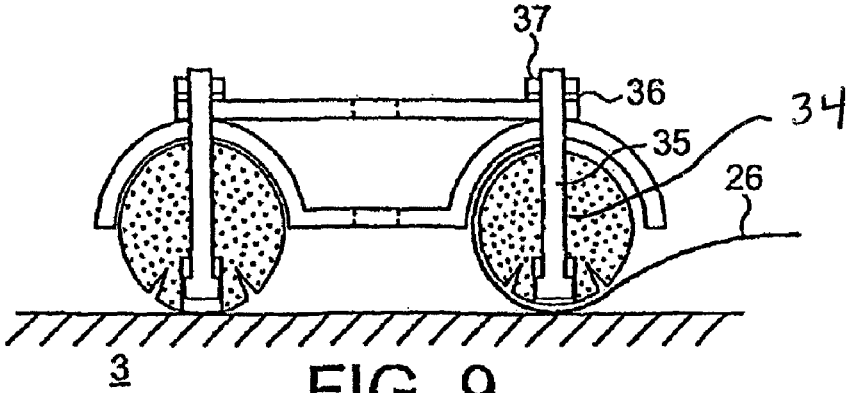

The compressible sealing members 23 and 24 may be formed of rubber, neoprene or a mixture thereof, and suitable lengths of such material are readily available, for example from Trelleborg of Sutton Coldfield, West Midlands. A particularly preferred material, in the form of an impregnated foam sealing material is sold under the Trademark Compriband® by Compriband Limited of Washington, Tyne-and-Wear, NE37 3JD. The sealing members 23 and 24 may suitably be provided with a low-tack adhesive to aid in location in their seats and with the waterproof flexible sheeting. Alternatively, the surface of the seats 18 and 19 may be provided with a low tack adhesive. FIG. 8 shows an alternative arrangement for locating the sealing members in their seats by providing projections 32 in the seats and corresponding location apertures 33 in the sealing members. FIG. 9 shows another alternative location system. Here the seals are provided at spaced intervals with through holes 34 in which are received screws 35 which mount the sealing members in position in the seats with co-operating washers 36 and nuts 37. When the sealing member is pressed against the confronting surface of the wall or the waterproof flexible sheeting, the through hole is effectively closed. In this latter arrangement, the edge region of the waterproof sheeting must be provided with notches or through openings for accommodating the shafts of screws 35, or else the edge region must be only partially wound about member 24 ending just short of the shaft of screw 35.

It will be appreciated that in the FIG. 9 arrangement, even though the seals are pierced by screws 35, these are not the "fuing" for fixing the frame and sheeting across the building opening being protected. As in all other arrangements in accordance with this invention, the fixings do not pierce the seal. This is important, because it is through such openings that any leakage would primarily take place. Even if there were some leakage through the openings in the seal accommodating the screws 35, this is to the reverse (or opposite) side of the sheeting, and—if anything—assists rather than destroys the seal of the sheeting against the building.

The second seal need not always have the slits 27. It may also be permanently adhered to its seat. With this arrangement, the first or inner seal can readily be manipulated into position into its seat with the edge of the waterproof sheet at least partially wound about the sealing member and without any tack, adhesive or other locating means, if the frame and fixings are loosely fitted to the building.

Waterproof flexible sheeting 26 must be sufficiently waterproof and sufficiently strong to meet the requirements both for natural wear-and-tear and the pressure that may be expected to bear against the sheet in a typical flood. Current indications are that in the region of 90% of flood entry/damage to dwellings occurs below first floor level. In other words, provision of flood protection systems in accordance with the present invention to all the openings (windows, doors and vents) below first floor level, coupled with appropriate flood-protection back-pressure valves in the drainage system will prevent almost all the damage caused by a typical flood.

Sheeting 26 should at least be capable of withstanding water pressure with a head as great as the difference in height from the lowest to the highest point of the region of the building being protected and, more preferably, at least the hydrostatic pressure provided by a head of 3 metres of water.

Sheeting that will meet these requirements is readily available commercially. For example, waterproof overlay protective sheeting of 0.75 mm thickness is readily available in various sizes to suit those regions of the building requiring flood protection. Such material consists of low density polyethylene sheet with reinforcing scrim. One such material is sold under the Trademark "Gridline 750" available from Monarflex of Lyon Way, St. Albans, Herts, AL4 0LB. They can provide sheet widths between 1.2 metres and 2.0 metres and then increasing in 200 mm increments to 4.0 metres.

In some cases, the waterproof flexible sheeting may be permanently mounted to the frame. Even though this arrangement does not have the advantage of the fully demountable arrangement that a householder can simply roll up the flexible sheeting for storage when no flood is expected, it will still be significantly lighter than would an arrangement employing rigid flood barriers. Sheeting is also adaptable to protect more complicated structures such as a curved or bay window, provided that the periphery of the region to be protected has appropriate permanent fixings as described above together with appropriately dimensioned frame and compressible means forming the seals.

Particular attention must be given to corner joints in the frame as these potentially provide a source of weakness for the ingress of flood water.

Figure 10:
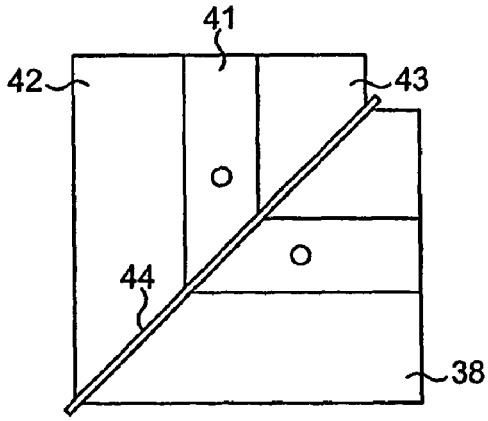
FIG. 10 is a top plan view of a corner gasket for sealing sections of frame.
Figure 11:
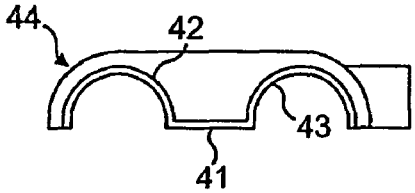
FIG. 11 is an elevational view of the gasket of FIG. 10 as seen from the right in FIG. 10.
Figure 12:
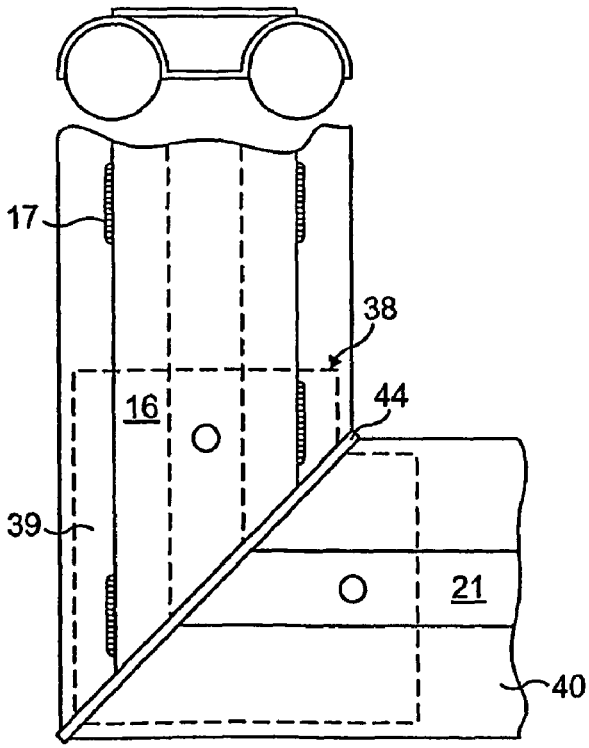
FIG. 12 is partial plan view of a frame showing the co-operation between two mitred frame sections and the gasket of FIGS. 10 and 11.

FIGS. 10 and 11 show an embodiment of corner sealing gasket 38 suitable for sealing mitred joints of two lengths of frame as best shown in FIG. 12 (in which the top bracing plate 16 of one of the frame sections is omitted for clarity).

Gasket 38 is suitably moulded from rubber, neoprene or a mixture and is adapted to fit on the underside of the respective mitred sections 39 and 40 of frame. To this end gasket 38 has flat centre sections 41 dimensioned to fit under central flat portions 21 of the respective frame sections 39 and 40. Gasket 38 also has elongate rounded sections 42 and 43 dimensioned to fit within respective seats 18 and 19 of the two frame sections 39 and 40. At the position of the confronting mitred ends, gasket 38 is provided with a flange 44 that serves to seal the butted mitred ends of the frame sections 39 and 40. Because the gasket is made of a compressible material, when the frame sections are butted as shown in FIG. 12 and then screwed into place using the location holes 22, which are located on longer ends 11 of respective fixing members 9, the gasket flange 44 accommodates any tolerances, misalignments, etc.

My initial practical arrangements, as described in detail above, contemplated winding of the sheeting edge partially about the inner seal, but I have since found, from long-term tests on a test rig in which the installation may be put under pressure to simulate the hydrostatic head and momentum of water that will occur in a real flood, that this is not necessary and that good results with no effective leakage can be achieved with the sheeting simply placed flat across a window or door opening with a first side of the sheeting pressed against the building surface and the frame placed against the opposite or reverse side of the sheeting.

With this arrangement, the frame may be formed from four extruded sections joined at the corners to make a solid frame, and with the sealing means permanently mounted in channels on the underside of the frame. If the sealing means are each formed as a continuous loop, they may be stretched slightly to fill the channels around all four sides of the frame, and being formed of flexible material will pass around the corners. This is advantageous, since the additional corner sealing structures described above with reference to FIGS. 10 to 12 may not then be necessary.

Preferably, in this arrangement, there are parallel inner and outer seals, and the positions of the fixing means for fixing the frame to the building surface with the sheeting therebetween lie between the two seals. Unless only the inner seal presses against the reverse or opposite side of the sheeting, this means that the sheeting must have apertures at the positions of the fixings. These apertures preferably have strengthening metal or plastics rivets to prevent weakening in the sheeting. It will be appreciated that even if there is any leakage through these apertures, this leakage would be on the radially outer side of the primary seal (with respect to the centre of the window or door opening being protected) and so will not provide leakage into the window or door opening. The use of the second or outer seal, although radially outward of the positions of the fixings and of the sheeting apertures (with regard to the centre of the window or door opening being protected), assists in mounting of the frame against the sheeting and provides at least some auxiliary sealing radially outward of the primary seal.

Figure 13:
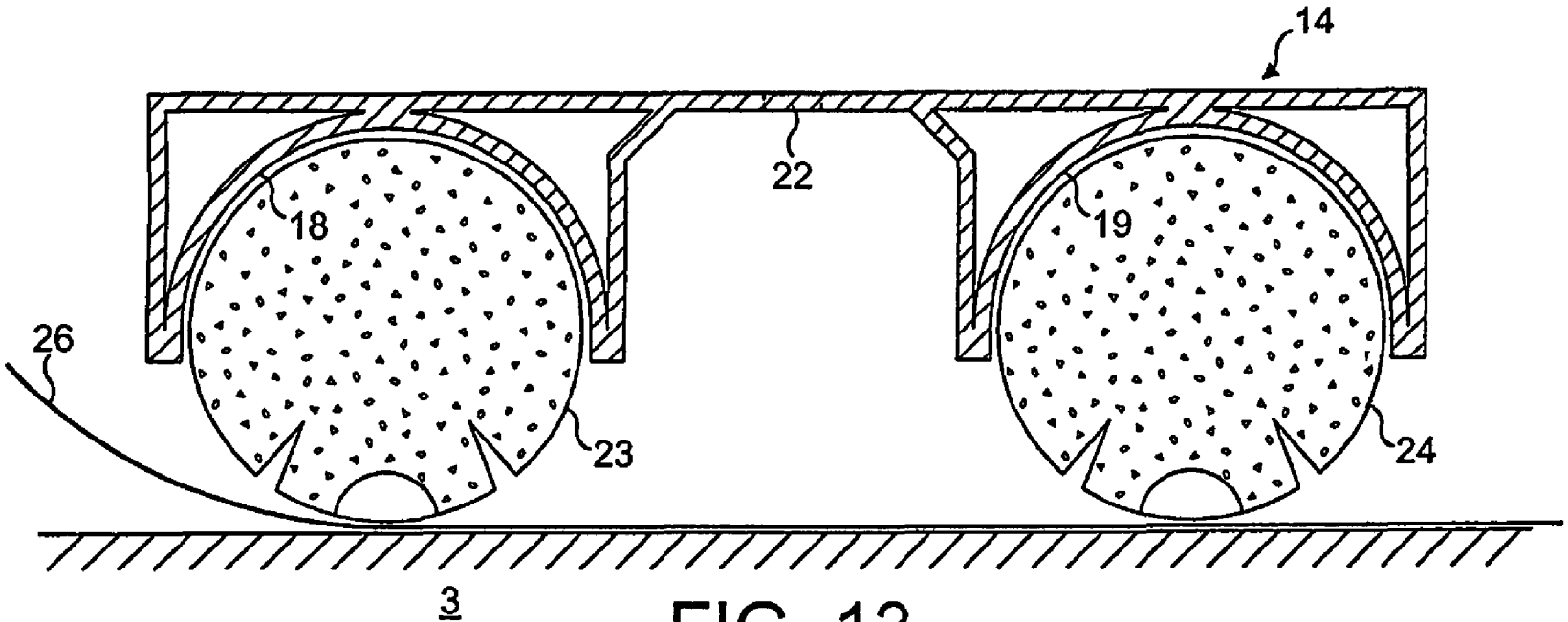
FIG. 13 is an enlarged sectional view through another embodiment of flood protection system according to the present invention.

This arrangement is illustrated in FIG. 13. Frame 14 in this embodiment is extruded from aluminium or an alloy thereof. The advantage of aluminum for this purpose is the ease with which it can be extruded coupled with its combination of light weight and strength. Thus each of the four sides of frame 14 can readily be formed as a one piece by extrusion. Alternatively, the whole frame may be formed from a single extruded section, with parts then being cut away so that the extrusion can be bent to form three corners, the two ends of the extrusion and cut edges at the three bent corners then being welded to form an integral four-sided frame.

I have found that use of the particular cross-sectional profile shown in FIG. 13 for the frame section extrusion is to be preferred over the simple pressed metal frame sections of the arrangements of FIGS. 6 to 12. When the fixing means are tightened in an arrangement using the profile of FIG. 13, the pressure of the sealing means against the sheeting, and hence of the sheeting against the confronting wall surface, is increased more rapidly and in a more predictable manner than when using the frame sections of the FIGS. 6 to 12 arrangements. Though lighter in weight than the steel frame sections of FIGS. 6 to 12, the aluminium frame section of FIG. 13 is more rigid.

Although all the arrangements described in detail hereinabove have two channels on the underside of the frame and two parallel seals, in some cases, a single seal may suffice. Either the same frame may be employed, but only with the inner or first seal present, or, alternatively, a frame with only a single seat for a single seal may be provided. In this latter case, the positions for the apertures in the frame for the fixings should be alongside the single channel so that the fixings do not pierce the seal.

In all cases of use of an embodiment of flood protection system in accordance with the present invention to protect a window, consideration should be given to the ability of the window itself to bear the pressure of a head of water, even when—to some extent—this is distributed over the area of the window via the protective waterproof sheet this sheet is suitably reinforced, but even so, in the case of older windows (modern sealed double-glazed units have substantially greater strength), especially those with small panes or that are leaded, an auxiliary means (for example a board or sheet formed of a suitable material such as plywood) will be useful in distributing the pressure across the window and/or in providing additional strengthening protection.

The invention claimed is:

1. A flood protection system for a building, comprising:

the building;

waterproof flexible sheeting of a size at least sufficient to cover a region to be protected on one or more faces of the building, the sheeting being adapted to withstand water pressure at least with a head as great as the difference in height from the lowest to the highest point of the said region, the sheeting having a first side and an opposite side on the side of the sheeting opposite the first side, the first side being arranged to bear against the surface of said one or more faces of the building at least around the periphery of said region;

a frame of similar dimension to said sheeting and adapted to mount said sheeting with said first side of said sheeting against the face of the building;

compressible sealing means;

the frame co-operating with said compressible sealing means, said compressible sealing means being adapted to bear against the opposite side of the sheeting to thereby press said first side against the face of the building;

and fixing means adapted to allow fixing of the frame to the surface of the one or more faces of the building when a flood is threatened to cause the compressible sealing means to bear against the said opposite side of the sheeting without the fixing means piercing the sealing means;

the fixing means being uncovered by the sheeting and accessible when the frame, compressible sealing means and sheeting are fixed to the one or more faces of the building to allow subsequent removal of said sheeting, frame and compressible sealing means from the one or more faces of the building when the threat of flood has passed.

2. A flood protection system according to claim 1, wherein a second compressible sealing means is positioned alongside the first mentioned said sealing means and is adapted to co-operate with the frame to bear directly against the face of the building to thereby provide an auxiliary seal between the frame and the building at a position outwardly relative to the periphery of the said region.

3. A flood protection system according to claim 1, wherein the sheeting is shaped and dimensioned to allow for edge regions thereof that are adapted to be at least partly wound about the first sealing means with said sealing means bearing against said opposite side.

4. A flood protection system according to claim 1, wherein a second compressible sealing means is positioned alongside the first mentioned said sealing means and is adapted to co-operate with the frame to bear against the face of the building via the sheeting to thereby provide an auxiliary seal between the frame and the sheeting and between the sheeting and the building at a position outwardly of said first sealing means relative to the centre of said region.

5. A flood protection system according to claim 2, wherein at least one of the first and second sealing means is provided with slits running therealong, thereby effectively dividing the sealing means into separate parallel sealing strips, each presenting a sealing edge to water attempting to circumvent the seal in a flood.

6. A flood protection system according to claim 2, wherein the sealing surface of at least one of the first and second sealing means defines generally hemispherical cavities therein, said cavities being adapted to close as the sealing means is compressed, thereby aiding in the accommodation of surface irregularities in the confronting surface of the building.

7. A flood protection system according to claim 4, wherein at least one of the first and second sealing means is provided with slits running therealong, thereby effectively dividing the sealing means into separate parallel sealing strips, each presenting a sealing edge to water attempting to circumvent the seal in a flood.

8. A flood protection system according to claim 4, wherein the sealing surface of at least one of the first and second sealing means defines generally hemispherical cavities therein, said cavities being adapted to close as the sealing means is compressed, thereby aiding in the accommodation of surface irregularities in the confronting surface of the building.

9. A flood protection system according to claim 1, wherein the frame has a first surface and a second surface on the side thereof opposite the first surface, the second surface being provided with a seat for the sealing means.

10. A flood protection system according to claim 2, wherein the frame has a first surface and a second surface on the side thereof opposite the first surface, the second surface being provided with respective seats for the first and second sealing means.

11. A flood protection system according to claim 10, wherein either the surface of the seat for one or each sealing means or the sealing means itself is provided with a temporary hold type adhesive to facilitate mounting of one or each said sealing means in the respective seat or seats for said one or each sealing means.

12. A flood protection system according to claim 10, wherein the second sealing means is permanently adhered to the respective seat for said sealing means.

13. A flood protection system according to claim 10, wherein the frame is formed of a magnetic material, and at least one of the first and second sealing means is formed with magnetic inclusions, to facilitate mounting thereof in the respective seat or seats for said at least one sealing means.

14. A flood protection system according to claim 10, wherein at least one of the first and second sealing means is provided with location openings and the frame is provided with corresponding location means adapted for co-operative location with the location openings.

15. A flood protection system according to claim 4, wherein the frame has a first surface and a second surface on the side thereof opposite the first surface, the second surface being provided with respective seats for the first and second sealing means.

16. A flood protection system according to claim 15, wherein either the surface of the seat for one or each sealing means or the sealing means itself is provided with a temporary hold type adhesive to facilitate mounting of one or each said sealing means in the respective seat or seats for said one or each said sealing means.

17. A flood protection system according to claim 15, wherein the second sealing means is permanently adhered to the respective seat for said sealing means.

18. A flood protection system according to claim 15, wherein the frame is formed of a magnetic material, and at least one of the first and second sealing means is formed with magnetic inclusions, to facilitate mounting thereof in the respective seat or seats for said at least one sealing means.

19. A flood protection system according to claim 15, wherein at least one of the first and second sealing means is provided with location openings and the frame is provided with corresponding location means adapted for co-operative location with the location openings.

20. A flood protection system according to claim 1, wherein the frame is generally rectangular in form and formed of separate frame sections for each side, corner regions of the frame where the frame sections butt being provided with corner sealing gaskets adapted to seal between said frame sections and between the frame sections and the sealing means.

21. A flood protection system according to claim 9, wherein the frame is generally rectangular in form and formed from an extrusion, the sealing means forming an endless loop stretched from its natural state to be mounted in said seat.

22. A flood protection system for a building, comprising:

the building;

a plurality of fixings permanently mounted in the wall of the building at spaced positions which together define a region on one or more faces of the building to be protected, each said fixing providing a socket adapted to receive a plug or cap masking the fixing from view when no flood is expected;

a plurality of male fixing members adapted to be received in respective said sockets when a flood is expected;

waterproof flexible sheeting of a size at least sufficient to cover the said region and adapted to withstand water pressure at least with a head as great as the difference in height from the lowest to the highest point of the said region;

a frame for sealingly mounting the said sheeting across the said region, the frame having an underside adapted to clamp the sheeting against the surface of said one or more surfaces by utilizing said male fixing members with the male fixing members passing through apertures in the frame and being received in the sockets, the frame being dimensioned to extend generally about the entire periphery of the said region, and the said underside defining a channel running therealong;

and one or more elongate compressible members adapted to fill said channel and to extend from the said underside in its uncompressed state, whereby the said compressible member are adapted to provide a seal around the periphery of said region, the apertures being located at spaced positions alongside said channel so that said fixings do not pierce the compressible members;

the male fixing members being uncovered by the sheeting and accessible when the frame, compressible sealing means and sheeting are fixed to the one or more faces of the building for removal of the male fixing members from said sockets when a threat of flood has passed to release said sheeting, frame and one or more compressible members from the one or more faces of the building.

23. A flood protection system according to claim 22, wherein the sheeting has an edge region adapted to be wound at least partly about the one or more members providing said seal in a direction such that the said member bears against the outer surface of said sheeting when the frame is clamped against the surfaces of said one or more faces.

24. A flood protection system according to claim 22, wherein said underside defines two generally parallel channels running therealong, with said apertures located between said channels at spaced positions; and respective elongate compressible members are adapted to fill the two said channels and to extend from the said underside in their uncompressed state, whereby the said compressible members are adapted to provide respective inner and outer seals for the said region.

25. A flood protection system according to claim 23, wherein said underside defines two generally parallel channels running therealong, with said apertures located between said channels at spaced positions; and respective elongate compressible members are adapted to fill the two said channels and to extend from the said underside in their uncompressed state, whereby the said compressible members are adapted to provide respective inner and outer seals for the said region; the edge region of the sheeting being adapted to be wound at least partly about the one or more members providing said inner seal.

26. A flood protection system according to any of claims 22, wherein each said fixing comprises a threaded member provided with a head including an internally threaded socket, the fixing being adapted to be threadedly inserted until the socket head is substantially flush with the face of building so that no part of the fixing protrudes from the said face, and the threaded socket being adapted to threadedly receive a co-operating said male fixing member, and also being adapted in the alternative to receive a masking plug or cap, selected from threaded plugs and caps and push-fix plugs and caps, to mask the fixing from view.

27. A flood protection system according to claim 26, wherein the male fixing member is double-ended; the said member having a first end which is threaded and a second end, opposite to the first, which is also threaded, the first end and the second end being separated by a collar, the length of the first end being the same as or less than the length of the internally threaded socket of the fixing, and the internally threaded socket and the first end being formed with co-operating screw threads; the frame being arranged to be mounted on said second ends and held in position by said second ends passing through said apertures in the frame and co-operating with a nut.

* * * * *